US009368277B2

(12) United States Patent
Takagi

(10) Patent No.: US 9,368,277 B2
(45) Date of Patent: Jun. 14, 2016

(54) METHOD FOR PRODUCING RFEB-BASED MAGNET

(71) Applicant: Shinobu Takagi, Aichi (JP)

(72) Inventor: Shinobu Takagi, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 0 days.

(21) Appl. No.: 14/492,444

(22) Filed: Sep. 22, 2014

(65) Prior Publication Data

US 2015/0086710 A1 Mar. 26, 2015

(30) Foreign Application Priority Data

Sep. 24, 2013 (JP) ..... 2013-196922

(51) Int. Cl.

| | |
|---|---|
| ***B05D 5/00*** | (2006.01) |
| ***H01F 41/16*** | (2006.01) |
| ***H01F 1/053*** | (2006.01) |
| ***H01F 1/055*** | (2006.01) |
| ***H01F 41/02*** | (2006.01) |

(52) U.S. Cl.

CPC *H01F 41/16* (2013.01); *B05D 5/00* (2013.01); *H01F 1/0536* (2013.01); *H01F 1/0551* (2013.01); *H01F 41/0293* (2013.01)

(58) Field of Classification Search

None

See application file for complete search history.

(56) References Cited

U.S. PATENT DOCUMENTS

| | | | | |
|---|---|---|---|---|
| 2,643,620 | A * | 6/1953 | Miller | A21C 11/163 100/185 |
| 7,112,348 | B2 * | 9/2006 | Mandai | B05C 5/0254 118/123 |
| 2003/0178103 | A1 * | 9/2003 | Harimoto | B22F 3/10 148/105 |
| 2004/0139913 | A1 * | 7/2004 | Kuromiya | B29C 47/0017 118/668 |
| 2008/0265055 | A1 * | 10/2008 | Quan et al. | 239/102.1 |
| 2010/0124602 | A1 * | 5/2010 | Solberg | C09D 11/02 427/58 |
| 2010/0172783 | A1 | 7/2010 | Hioki et al. | |
| 2013/0153088 | A1 * | 6/2013 | Dreikorn et al. | 148/104 |
| 2013/0175728 | A1 | 7/2013 | Miyawaki et al. | |
| 2015/0059525 | A1 * | 3/2015 | Sagawa et al. | 75/246 |

FOREIGN PATENT DOCUMENTS

| | | |
|---|---|---|
| EP | 2772926 | 9/2014 |
| JP | 2006-19521 | 1/2006 |

(Continued)

OTHER PUBLICATIONS

Search report of WO2014148353 available Jun. 2014.*

Sokeizai et al., "Development of Dy-omitted Nd—Fe—B-based hot worked magnet by using a rapidly quenched powder as a raw material", General Incorporation Foundation Sokeizai Center, vol. 52, No. 8, Aug. 2011, pp. 19-24.

(Continued)

*Primary Examiner* — Mandy Louie

(74) *Attorney, Agent, or Firm* — Greenblum & Bernstein, P.L.C.

(57) ABSTRACT

Provided is a method for producing an RFeB-based magnet, the method including: disposing a nozzle so as to be opposed to an attachment surface of a base material that is a sintered magnet or hot-plastic worked magnet composed of an RFeB-based magnet containing a light rare earth element $R^L$ that is at least one element selected from the group consisting of Nd and Pr, Fe, and B; ejecting a mixture, from the nozzle, obtained by mixing an organic solvent and an $R^H$-containing powder containing a heavy rare earth element $R^H$ that is at least one element selected from the group consisting of Dy, Tb and Ho so as to attach the mixture to the attachment surface; and heating the base material together with the mixture.

5 Claims, 4 Drawing Sheets

(56) References Cited

FOREIGN PATENT DOCUMENTS

| | | |
|---|---|---|
| JP | 2006-303433 | 11/2006 |
| WO | 2011/136223 | 11/2011 |
| WO | 2013/061836 | 5/2013 |
| WO | WO2013146781 | * 10/2013 ..... B22F 3/24 |

OTHER PUBLICATIONS

U.S. Appl. No. 14/501,966 to Takagi, filed Sep. 30, 2014.
U.S. Appl. No. 14/502,056 to Takagi, filed Sep. 30, 2014.

* cited by examiner

METHOD FOR PRODUCING RFEB-BASED MAGNET

FIELD OF THE INVENTION

The present invention relates to a method for producing an RFeB-based magnet that contains R (R is a rare earth element), Fe, and B. More specifically, the present invention relates to a method for producing an RFeB-based magnet which includes a process (grain boundary diffusion process) of diffusing at least one element selected from the group consisting of Dy, Tb and Ho (hereinafter, at least one element selected from the group consisting of Dy, Tb and Ho is referred to as "heavy rare earth element $R^H$") to the vicinity of surfaces of main phase grains that contain at least one element selected from the group consisting of Nd and Pr (hereinafter, at least one element selected from the group consisting of Nd and Pr is referred to as "light rare earth element $R^L$") as a main rare earth element R through a grain boundary of the main phase grains.

BACKGROUND OF THE INVENTION

A RFeB-based magnet was found by Sagawa et. al in 1982, and has an advantage that many magnetic properties such as residual magnetic flux density are higher than those of permanent magnets in the related art. Accordingly, the RFeB-based magnet has been used in various products such as a drive motor of a hybrid car and an electric car, a motor for electrically-assisted bicycles, an industrial motor, a voice coil motor of a hard disk drive and the like, a high-performance speaker, a headphone, and a permanent magnet-type magnetic resonance diagnostic device.

Early RFeB-based magnets have a defect that among various magnetic properties, a coercive force $H_{cJ}$ is relatively low. However, it has been found that the coercive force is improved by making the heavy rare earth element $R^H$ be present inside the RFeB-based magnets. The coercive force is a force that resists inversion of magnetization when a magnetic field in a direction opposite to a direction of the magnetization is applied to a magnet, but it is considered that the heavy rare earth element $R^H$ hinders the inversion of magnetization and thus has an effect of increasing the coercive force.

When examining a magnetization inversion phenomenon in the magnet in detail, there is a characteristic that the magnetization inversion occurs at first in the vicinity of a grain boundary of crystal grains and is diffused to the inside of the crystal grains therefrom. Therefore, in a case where the magnetization inversion at the grain boundary is blocked at first, it is effective for prevention of the magnetization inversion of the entirety of the magnet, that is, an increase in the coercive force. Accordingly, the heavy rare earth element $R^H$ should be present in the vicinity of the grain boundary of the crystal grains.

On the other hand, when considering the entirety of main phase grains, if an amount of the $R^H$ increases, a residual magnetic flux density $B_r$ decreases, and thus there is a problem that the maximum energy product $(BH)_{max}$ also decreases. In addition, the $R^H$ is a rare resource and is expensive, and a production area is localized, and thus it is not preferable to increase the amount of $R^H$. Accordingly, it is preferable that the $R^H$ is present in a small amount at the inside of the crystal grains, and be present in a large amount (unevenly distributed) in the vicinity of a surface (in the vicinity of the grain boundary) to increase the coercive force (to prevent a reverse magnetic domain from being formed as much as possible) while suppressing the amount of $R^H$ as much as possible.

As a method of unevenly distributing the $R^H$ in the vicinity of the surface rather than the inside of the crystal grains, a grain boundary diffusion method is known (for example, refer to Patent Document 1 and Patent Document 2). In the grain boundary diffusion method, a powder, which contains the $R^H$ as an elementary substance, a compound, or an alloy (hereinafter, a powder that contains the $R^H$ is referred to as "$R^H$-containing powder" regardless of the type such as the elementary substance, the compound, and the alloy), and the like is attached to a surface of the RFeB-based magnet, and the RFeB-based magnet is heated. According to this, the $R^H$ penetrates to the inside of the magnet through the grain boundary of the RFeB-based magnet, and thus atoms of the $R^H$ are diffused only in the vicinity of the surface of the crystal grains. Hereinafter, an RFeB-based magnet before performing the grain boundary diffusion process is referred to as a "base material" and is discriminated from an RFeB-based magnet after performing the grain boundary diffusion process.

There are various methods of attaching the $R^H$-containing powder to the base material. Patent Document 1 discloses that the base material is immersed in a turbid solution in which $TbF_3$ powder that is an $R^H$-containing powder and ethanol are mixed, and then the base material is pulled up from the turbid solution and is dried, thereby attaching the $R^H$-containing powder to the surface of the base material. However, in this method, it is difficult to control an amount of the $R^H$-containing powder that is attached to the surface of the base material, and it is also difficult to uniformly attach the $R^H$-containing powder to the surface of the base material in an arbitrary thickness. Therefore, the rare and expensive $R^H$-containing powder is consumed more than necessary.

On the other hand, Patent Document 2 discloses a method of applying (attaching) a mixture obtained by mixing the $R^H$-containing powder and an organic solvent to the surface of the base material by using a screen printing method. Specifically, a plurality of flat plate-shaped base materials are arranged, and a screen in which a plurality of transmission portions capable of transmitting the mixture therethrough are provided in correspondence with the position of the base materials is extended on the surface of the base material. The mixture is supplied on the screen, and then a surface of the screen is scrubbed with a squeegee, thereby attaching the mixture to the surface of the base material through the screen at the transmission portions. Accordingly, it is possible to apply the mixture to the surface of the respective base materials in a uniform thickness, and thus the $R^H$-containing powder is not consumed more than necessary.

In addition, the RFeB-based magnet is largely classified into (i) a sintered magnet obtained by sintering a raw material alloy powder containing a main phase grain as a main component, (ii) a bonded magnet obtained by consolidating raw material alloy powders with a binding agent (binder composed of an organic material such as a polymer and an elastomer) and by molding the consolidated powders, and (iii) a hot-plastic worked magnet obtained by performing a hot press working and hot plastic working with respect to a raw material alloy powder (refer to Non-Patent Document 1). Among these magnets, the grain boundary diffusion process may be performed in (i) sintered magnet and (iii) hot-plastic worked magnet in which the binder of the organic material is not used and thus heating during the grain boundary diffusion process can be performed.

[Patent Document 1] JP-A-2006-303433
[Patent Document 2] WO2011/136223
[Patent Document 3] JP-A-2006-019521
[Non-Patent Document 1] "Development of Dy-omitted Nd—Fe—B-based hot worked magnet by using a rapidly quenched powder as a raw material" written by Hioki Keiko and Hattori Atsushi, Sokeizai, Vol. 52, No. 8, pages 19 to 24, General Incorporation Foundation Sokeizai Center, published on August, 2011.

SUMMARY OF THE INVENTION

A target of Patent Document 2 is a flat plate-shaped base material, and thus a surface of the base material to which the mixture is applied is a planar surface. However, typically, a shape of the magnet is not limited to the flat plate shape. For example, in a rotor of a motor in which the RFeB-based magnet is frequently used, a plurality of the RFeB-based magnets are arranged in a rotational direction, and a magnet, in which a surface facing an inner surface of a stator is formed in a convex arc shape in correspondence with a shape of the inner surface of the stator, is used as the RFeB-based magnets. In the RFeB-based magnet for motors, to impart uniform magnetic properties, particularly, to the entirety of the arc-shaped surface that faces the stator, it is necessary for the mixture to be uniformly applied to the surface. However, in the screen printing method disclosed in Patent Document 2, the plurality of base materials are arranged, and then the screen printing is performed. Therefore, in a case where the surface of each of the base materials is a curved surface, it is difficult to apply the mixture to the surface of the base material in a uniform thickness.

An object of the present invention is to provide a method for producing an RFeB-based magnet which is capable of attaching a mixture obtained by mixing an $R^H$-containing powder and an organic solvent to a surface of a magnet base material in a grain boundary diffusion process even when the surface of the magnet base material is a nonplanar surface, and which is capable of uniformly attaching the mixture to the surface of the base material of the magnet in an arbitrary thickness regardless of a planar surface and a nonplanar surface.

In order to solve the above-mentioned problems, the present invention provides a method for producing an RFeB-based magnet, the method including: disposing a nozzle so as to be opposed to an attachment surface of a base material that is a sintered magnet or hot-plastic worked magnet composed of an RFeB-based magnet containing a light rare earth element $R^L$ that is at least one element selected from the group consisting of Nd and Pr, Fe, and B; ejecting a mixture, from the nozzle, obtained by mixing an organic solvent and an $R^H$-containing powder containing a heavy rare earth element $R^H$ that is at least one element selected from the group consisting of Dy, Tb and Ho so as to attach the mixture to the attachment surface; and heating the base material together with the mixture.

In the present invention, the mixture is ejected from the nozzle, thereby attaching the mixture to the attachment surface. As a result, an operation may be performed in a non-contact manner with respect to the attachment surface of the base material, and thus there is no restriction in accordance with the shape of the attachment surface. Accordingly, it is also possible to uniformly attach the mixture in an arbitrary thickness to a nonplanar attachment surface such as an arc-shaped surface in an RFeB-based magnet that is used as rotor of a motor.

On the other hand, different amounts of the mixture may be attached to the attachment surface based on each position on the attachment surface.

The coercive force may locally decrease in the RFeB-based magnet in accordance with a shape of the attachment surface due to the following reason. In this case, it is preferable to attach a greater amount of the mixture to the attachment surface corresponding to the position at which the coercive force decreases. According to the method of the present invention, it is possible to easily adjust the attached amount of the mixture in accordance with the position on the attachment surface. As the reason of the local decrease in the coercive force, the following situations and the like may be exemplified. Firstly, a demagnetizing field due to magnetization, which is a cause of a decrease in the coercive force, becomes locally strong at a position at which a thickness in a magnetization direction is smaller than that of other positions. Secondly, temperature rising, which is a cause of the decrease in the coercive force, locally increases in accordance with the shape of the RFeB-based magnet due to an eddy current that is generated in the RFeB-based magnet along with a variation in an external magnetic field during use.

In addition, a heating temperature may be substantially the same as a temperature in heating that is performed in a grain boundary diffusion process of the related art. Typically, the heating temperature is approximately 800° C. to 950° C., but may be in other temperature ranges as long as the grain boundary diffusion is realized.

In the present invention, it is preferable that silicone grease is used as the organic solvent. Silicone is a polymer expressed by General Formula $X_3SiO—(X_2SiO)_n—SiX_3$ (in which X represents organic groups, and it is not necessary for respective organic groups to be the same as each other), and has a main chain having a "siloxane bonds" in which a Si atom and an O atom are alternately coupled. When the silicone grease is used as the solvent in the mixture, adhesion of the mixture to the base material increases. Accordingly, when performing heating to diffuse the $R^H$ to the grain boundary of the base material, it is possible to prevent the mixture from being peeled from the attachment surface.

The smaller the maximum particle size of the $R^H$-containing powder is and the lower a viscosity of the mixture is, the easier the mixture passes through the nozzle. Accordingly, it is preferable that a ratio of the maximum particle size of the $R^H$-containing powder to a diameter of the nozzle is 0.15 or less, and more preferably 0.10 or less. In addition, with regard to the maximum particle size, a different value is obtained in accordance with a measurement method. However, in the present specification, a value that is measured by a laser diffraction type particle size distribution measuring method is used. In addition, it is preferable that the viscosity of the mixture is 30 Pa·s or less, more preferably 10 Pa·s or less, and still more preferably 5 Pa·s or less.

According to the present invention, in a grain boundary diffusion process, it is possible to uniformly attach a mixture obtained by mixing an $R^H$-containing powder and an organic solvent to a nonplanar attachment surface of a base material in an arbitrary thickness in a non-contact manner.

DETAILED DESCRIPTION OF THE INVENTION

Examples of a method for producing an RFeB-based magnet according to the present invention will be described with reference to FIGS. 1 to 4.

Examples

Figure 1:
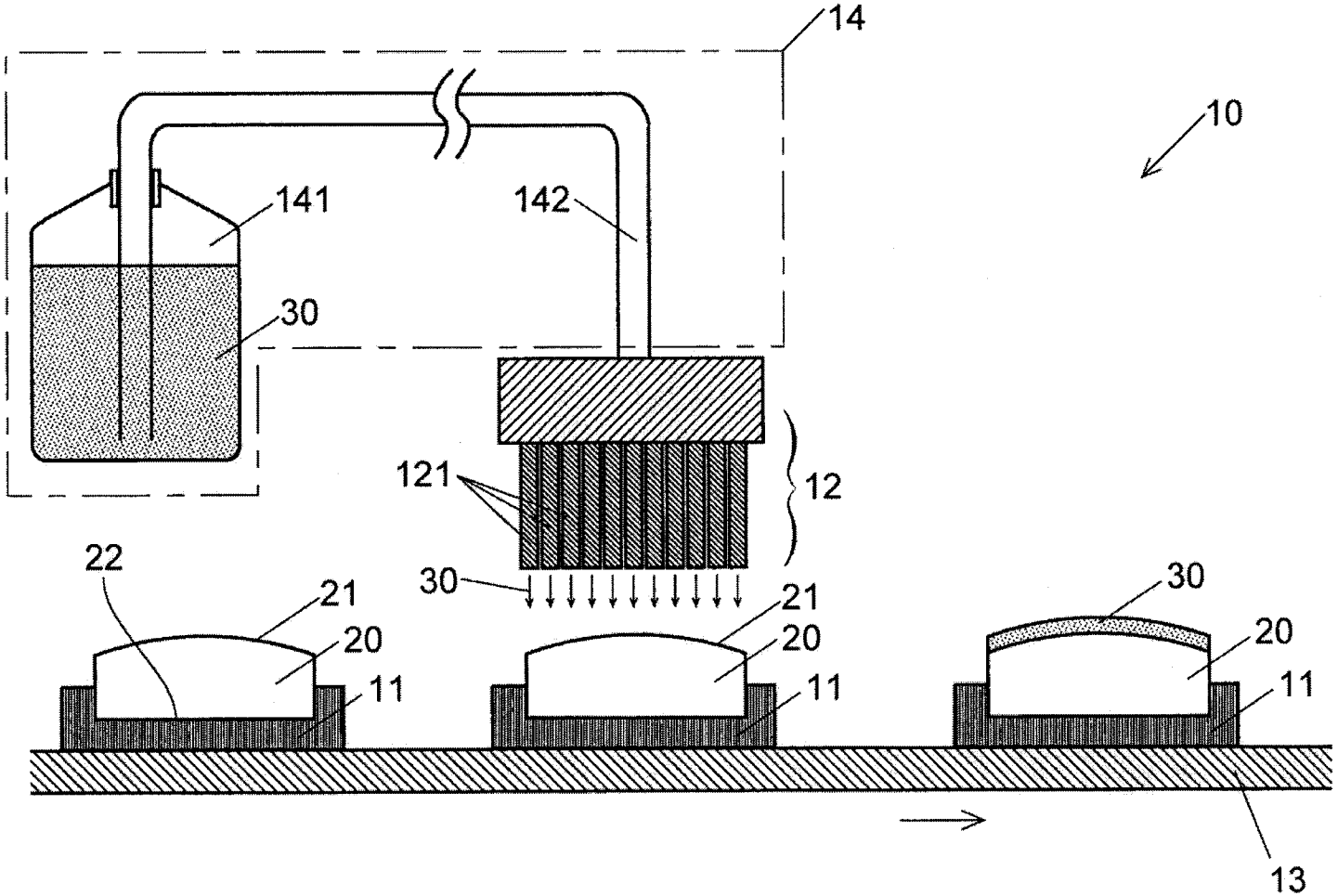
FIG. 1 is a schematic configuration view illustrating a mixture supply apparatus that is used in a method for producing an RFeB-based magnet according to Examples.

FIG. 1 illustrates a schematic configuration of a mixture supply apparatus 10 that is used to attach a mixture of the $R^H$-containing powder and an organic solvent to a nonplanar attachment surface 21 of a base material 20 of an RFeB-based magnet in a method for producing the RFeB-based magnet according to Examples. The mixture supply apparatus 10 includes a base material holding unit 11, a nozzle head 12, a base material transporting unit 13, and a mixture supply unit 14.

The base material holding unit 11 holds the base material 20 in a state in which the attachment surface 21 faces an upper side. In Examples, as the base material holding unit 11, a plate-shaped member, in which a concave portion having a planar shape that is slightly larger than a lower surface 22 of the base material 20 is provided on an upper surface, is used. One piece of the base material 20 is shown in FIG. 1, but a plurality of the base materials 20 may be held by one base material holding unit 11. In this case, the plurality of base materials 20 may be arranged in a depth direction or in a right and left direction of FIG. 1. In addition, the plurality of base materials 20 may be two-dimensionally arranged in both of the depth directions and the right and left directions.

The nozzle head 12 includes a plurality of nozzles 121, an ejection device (not shown) that is attached to each of the nozzles 121, and a controller (not shown) that controls the ejection device. The nozzle head 12 is disposed so as to be opposed to the attachment surface 21 of the base material 20 that is held by the base material holding unit 11. A plurality of nozzles 121 are disposed to the nozzle head 12 to cover the entirety of the attachment surface 21. In FIG. 1, the plurality of nozzles 121 are shown to be arranged only in a transverse direction, but actually, the plurality of nozzles 121 are also arranged in the depth direction of the drawing in the same way. In addition, the number of the nozzle heads 12 is appropriately changed in accordance with the number of the base materials 20. For example, in a case where the plurality of base materials 20 are held by one base material holding unit 11, the nozzle head 12 may also be provided in the same number as that of the base materials 20 so as to be opposed to the attachment surface 21 of each of the base materials 20. The ejection device is provided with a pneumatic or electromagnetic solenoid type actuator. In the ejection device, when a signal is transmitted to the actuator from the controller, a valve element or a piston moves, thereby extruding a mixture 30 from each of the nozzles 121. In addition, as the actuator, a piezo element (piezoelectric element) may be used. In addition, the number of the nozzles 121 that are used in one nozzle head 12 is appropriately changed in accordance with the size of each of the base materials 20 and an application area. For example, the nozzle head 12 may be set as a single nozzle having only one nozzle 121 instead of a multi-nozzle having a plurality of nozzles 121 as shown in FIG. 1.

The base material transporting unit 13 sequentially transports the base material holding unit 11 that holds the base material 20 to a position immediately below the nozzle head 12, and transports the base material holding unit 11 after the mixture is applied to the attachment surface 21 to another position from the position immediately below the nozzle head 12. In Examples, a belt conveyor is used as the base material transporting unit 13, but an XY stage, a robot arm, and the like may be used.

The mixture supply unit 14 includes a mixture tank 141 that stores the mixture 30 of the $R^H$-containing powder and the organic solvent, and a supply tube 142 that supplies the mixture 30 from the mixture tank 141 to each of the nozzles 121.

Operation of the mixture supply apparatus 10 will now be described. The base material holding unit 11 in which the base material 20 is held in a state in which the attachment surface 21 faces an upper side is moved by the base material transporting unit 13 in such a manner that the attachment surface 21 is disposed immediately below the nozzle head 12. Next, when receiving an electrical signal from a driver, the ejection device ejects the mixture 30 from the nozzle 121 toward the attachment surface 21, whereby the mixture 30 is attached to the attachment surface 21. Then, the base material transporting unit 13 moves the base material holding unit 11, which is positioned immediately below the nozzle head 12, from the position, and moves the subsequent base material holding unit 11 to the position. A process of sequentially attaching the mixture 30 to the attachment surface 21 of the plurality of base materials 20 is performed by repeating the above-described operation.

In addition, the mixture supply apparatus 10 uses the nozzle head 12 in which the plurality of nozzles 121 are disposed to cover the entirety of the attachment surface 21, but the nozzle head 12 is appropriate for mass production of the RFeB-based magnet by using the base materials 20 which have the attachment surface 21 of the same shape. On the other hand, in a case of handling a plurality of kinds of base materials 20, in which the shape of the attachment surface 21 is different in each case, with one mixture supply apparatus, or in a case of partially attaching the mixture 30, a nozzle head which is movable in the right and left directions and/or the depth direction in FIG. 1, and in which the number of the nozzles 121 is reduced in comparison to that shown in the same drawing may be used as the nozzle head 12. That is, it is possible to uniformly supply the mixture 30 even to the attachment surface 21 having a different shape by supplying the mixture 30 to the attachment surface 21 while moving the nozzle head 12 in accordance with the shape of the attachment surface 21.

Figure 2:
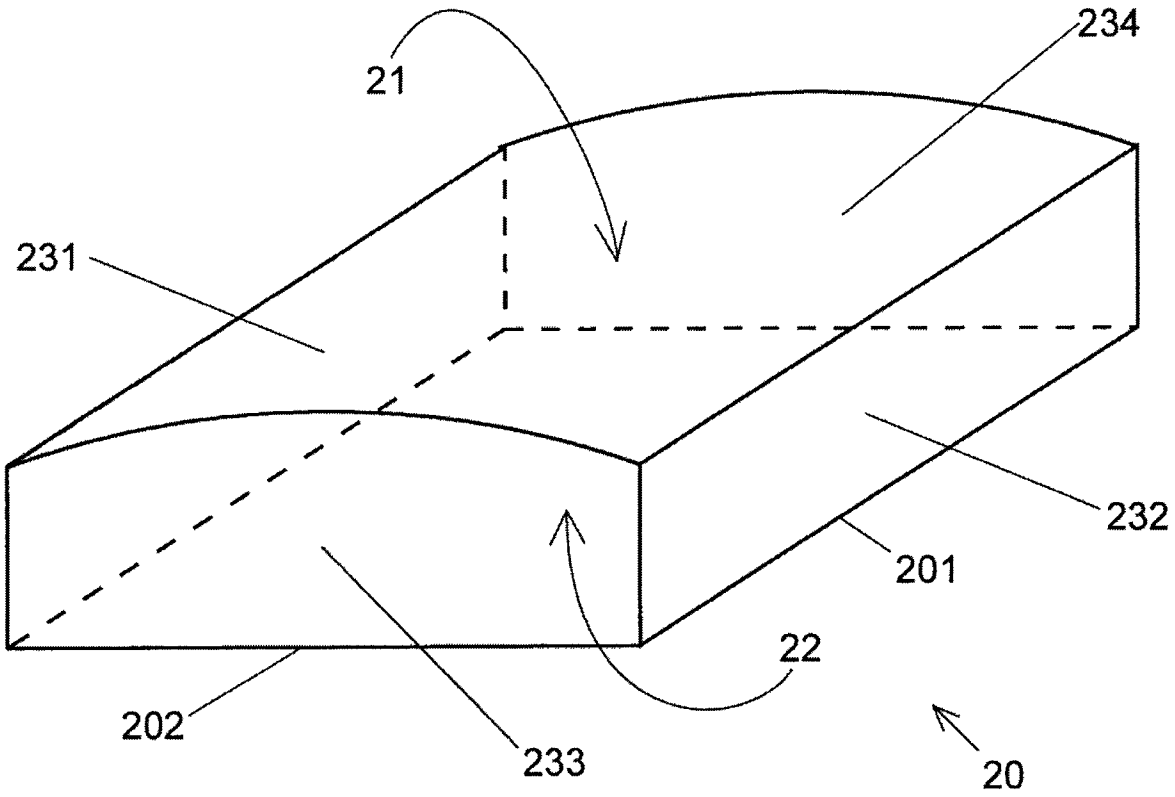
FIG. 2 is a perspective view illustrating a shape of a base material of the RFeB-based magnet that is manufactured in Examples.

Next, the shape of the base material 20 of the RFeB-based magnet which is used in Examples is shown in FIG. 2. The base material 20 that is used in Examples has a rectangular lower surface 22 in which the length of a long side 201 is 16 mm and the length of a short side 202 is 14 mm, first and second side surfaces 231 and 232 which erect from two long sides 201 and are opposite to each other, third and fourth side surfaces 233 and 234 which erect from two short sides 202 and are opposite to each other, and an upper surface 21 that is opposite to the lower surface 22. The upper surface 21 has an upwardly convex arc shape in a cross-section that is parallel with the short side 202 of the lower surface 22, and the cross-sectional shape is the same regardless of a position in a direction parallel with the long side 201 of the lower surface 22. A radius of curvature of the arc in the cross-section is R32 mm, and a height (a distance between the upper surface 21 and the lower surface 22) is 4.7 mm at opposite ends of the cross-section and 5.7 mm at the central portion thereof. In correspondence with the shape of the upper surface 21, the first and second side surfaces 231 and 232 have a rectangular shape, and the third and fourth side surfaces 233 and 234 have an upwardly convex shape.

The base material 20 was prepared by the following sintering method. First, flake-shaped alloy pieces having a thickness of approximately 0.3 mm were prepared from an alloy having a composition of Nd: 25.8, Pr: 4.7, Dy: 0.3, B: 0.99, Co: 0.9, Cu: 0.1, Al: 0.2, and Fe: the remainder in terms of a weight percentage by a strip cast method. Next, the flake-shaped alloy pieces were crushed by a known hydrogen crushing method, thereby preparing an irregular powder of the alloy which has a size of approximately 0.1 mm to 1 mm. Continuously, the irregular powder was pulverized by a jet mill apparatus, thereby preparing an alloy fine powder having a particle size of approximately 3 μm. The obtained alloy fine powder was filled in a mold having a cavity corresponding to the shape of the base material 20. Next, the alloy fine powder inside the mold was oriented in a magnetic field as is without compression molding. In addition, in a state in which the alloy fine powder after the orientation was filled in the mold, heating was performed in vacuo until the temperature reached 1000° C. without performing the compression molding, and the alloy fine powder was retained at the temperature for 4 hours, thereby sintering the alloy fine powder. According to this, the base material 20 was obtained. In addition, the method of preparing the RFeB-based sintered magnet in this manner without performing the compression molding is called a PLP (Press-less Process) method, and is known as a method which is capable of increasing the coercive force while suppressing a decrease in the residual magnetic flux density and which is capable of obtaining a sintered body having a shape corresponding to the shape of the cavity of the mold. Details of the PLP method are described in Patent Document 3.

Next, the mixture 30 of the $R^H$-containing powder and the organic solvent will now be described. The mixture 30, which is used in Examples, contains Tb as the $R^H$ and also contains silicone grease as the organic solvent. The mixture 30 was prepared as follows. First, a TbNiAl alloy containing Tb, Ni, and Al in a weight ratio of 92:4.3:3.7 was pulverized, thereby preparing a Tb-containing powder ($R^H$-containing powder). Next, the obtained Tb-containing powder, the silicone grease, a silicone fluid, and methyl laurate as a dispersing agent were mixed in the following mixing ratio, thereby obtaining the mixture 30. As the mixture 30, a plurality of kinds of mixtures, in which the maximum particle size of the Tb-containing powder and the mixing ratio were different in each case, were prepared. In addition, in Example 1 to be described later, the silicone fluid was not used. In addition, the silicone fluid was added to adjust a viscosity of the mixture 30, and the dispersing agent was added to increase dispersibility of the Tb-containing powder in the mixture 30. The silicone fluid and the dispersing agents are not requisite in the present invention.

The mixture 30 was ejected from the nozzle 121 in a state in which the upper surface 21 of the base material 20 obtained as described was set as the attachment surface, thereby attaching the mixture 30 to the attachment surface. Similarly, the mixture 30 was also attached to the lower surface 22 of the base material 20. Here, an experiment was performed using four examples (Examples 1 to 4) in which the mixing ratio in the mixture 30, the maximum particle size of the Tb-containing powder, the viscosity of the mixture 30, and the diameter of the nozzles were different in each case. Experiment conditions and results are shown in Table 1. In addition, in Table 1, with regard to the mixing ratio, the total content rate of the Tb-containing powder, the silicone grease, and the silicone fluid was set to 100% by weight for convenience, and a content rate of the dispersing agent having a content rate lower than that of these three kinds was expressed as a ratio with respect to the total weight of these three kinds.

TABLE 1

Mixtures that were prepared, and results of an experiment of attaching the mixtures to the attachment surface of the base material

| | Mixing ratio (weight ratio) (TB:G:O:L) | Maximum particle size of Tb-containing powder $R_{max}$ [μm] | Viscosity (room temperature) [Pa · s] | Diameter ϕ of nozzle [μm] | $R_{max}/\phi$ | Clogging of nozzle | Film thickness of mixture [μm] |
|---|---|---|---|---|---|---|---|
| Example 1 | 80:20:0:0.2 | 30 | 25 | 200 | 0.15 | None | 516 |
| Example 2 | 80:10:10:0.2 | 20 | 2 | 200 | 0.10 | None | 103 |
| Example 3 | 80:10:10:0.2 | 10 | 10 | 150 | 0.067 | None | 48 |
| Example 4 | 75:10:15:0.2 | 10 | 1 | 100 | 0.10 | None | 28 |

TB: Tb-containing powder,
G: Silicone grease,
O: Silicone fluid,
L: Dispersing agent As a result of the experiment, in all Examples, the mixture 30 could be attached to not only the flat lower surface 22 but also the nonplanar upper surface 21 in an approximately uniform thickness. In addition, a film thickness of the mixture 30 that was attached to the attachment surface could be adjusted in a broad range of 28 μm to 516 μm. Here, the smaller the diameter of the nozzle was and the lower the viscosity of the mixture 30 was, the less an ejected amount of the mixture 30 was, and thus it was possible to make the film thickness small. As the amount of the Tb-containing powder is small, as the amount of the silicone grease having a high viscosity is small, or as the amount of silicone fluid having a low viscosity is large, the viscosity of the mixture 30 can be made to be lower. In addition, in all Examples, clogging of the nozzle (clogging due to the mixture 30) did not occur. However, in a case where the clogging of the nozzle occurs, adjustment may be performed in such a manner that the viscosity of the mixture 30 decreases, or the diameter of the nozzle increases.

With regard to Examples 1 to 4, the base material 20 in which the mixture 30 was attached to the upper surface (attachment surface) 21 was heated in vacuo at 900° C. for 10 hours in order for the mixture 30 to be supplied to the vicinity of the surface of crystal grains through a grain boundary thereof. Then, the base material 20 was subject to an aging process of performing heating at a temperature of 500° C. for 3 hours, and a magnetizing process of applying a magnetic field of 4.5 T in a thickness direction of the base material 20, thereby obtaining an RFeB-based magnet that is a final product.

Next, magnetic properties of the RFeB-based magnet that was obtained in Examples 1 to 4, and an RFeB-based magnet that was obtained in Reference Example to be described below were measured. In Reference Example, the mixture was applied in a thickness of 32 μm to an upper surface and a lower surface of a rectangular parallelepiped, which has a thickness of 6 mm and in which the upper surface and the lower surface have a rectangular shape having long sides of 16 mm and short sides of 14 mm, by using a screen printing method. A mixture, in which the mixing ratio of the Tb-containing powder, the silicone grease, the silicone fluid, and the dispersing agent was 80:10:10:0.2 (weight ratio), and the maximum value of the particle size of the Tb-containing powder was 30 μm, was used as the mixture in Reference Example. With regard to measurement of the magnetic properties, test specimens of 7 mm×7 mm×4 mm were cut from the RFeB-based magnets which were obtained in Examples 1 to 4 and Reference Example, and measurement on a residual magnetic flux density and a coercive force at room temperature was performed with respect to the test specimens by using a BH tracer. Measurement results of the magnetic properties are shown in Table 2.

TABLE 2

Magnetic properties of specimens that were prepared

| | Residual magnetic flux density $B_r$ [kG] | Coercive force $H_{cj}$ [kOe] |
|---|---|---|
| Example 1 | 14.1 | 24.7 |
| Example 2 | 14.2 | 24.6 |
| Example 3 | 14.3 | 24.3 |
| Example 4 | 14.3 | 24.0 |
| Reference Example | 13.9 | 23.9 |

From the experiment results, it was confirmed that all of the RFeB-based magnets that were obtained in Examples 1 to 4 have substantially the same residual magnetic flux density and coercive force as Reference Example. That is, according to Examples, through the grain boundary diffusion process in which the nonplanar surface of the base material having the nonplanar surface is set as the attachment surface of the mixture, it is possible to obtain substantially the same magnetic properties as that obtained in the grain boundary diffusion process that has been performed with respect to a rectangular parallelepiped base material of the related art.

The present invention is not limited to Examples.

For example, in Examples, the Tb-containing powder obtained by making the TbNiAl alloy into a powder was used as the $R^H$-containing powder, but a Dy-containing powder or a Ho-containing powder may be used, and an elementary substance or a compound (a fluoride and the like) of the $R^H$ may be used in addition to the alloy. In addition, as the organic solvent, in addition to the silicone grease or the silicone fluid which are used in Examples, liquid hydrocarbon such as flowable paraffin, hexane, and cyclohexane may be used.

Figure 3B:
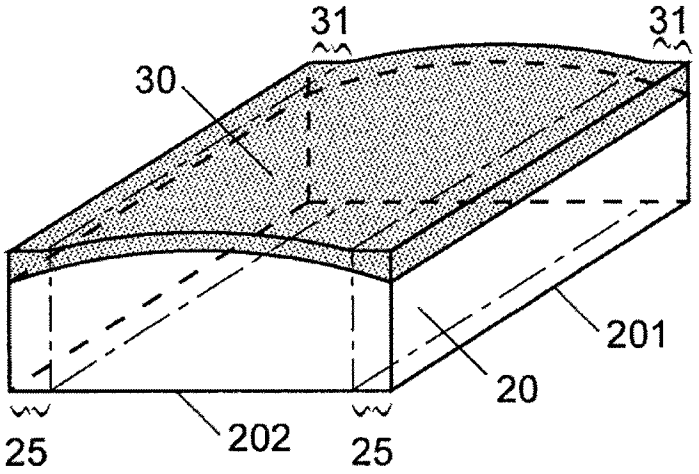
FIGS. 3A and 3B are views illustrating an example of a mixture attaching position in the base material of the RFeB-based magnet that is manufactured in Examples.
Figure 3A:
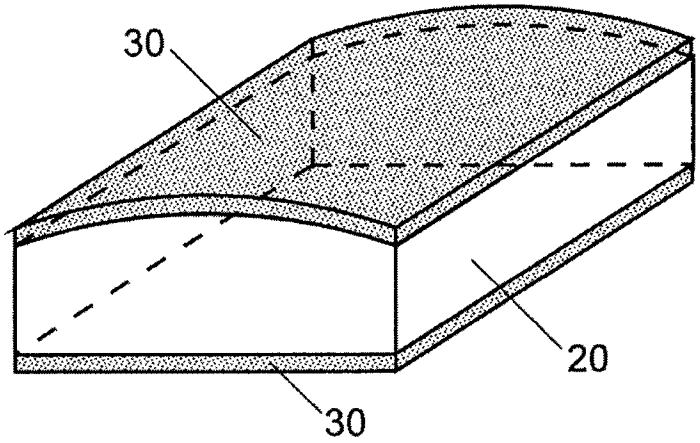

In addition, in Examples, the mixture 30 is uniformly attached to the entirety of the upper surface 21 (FIG. 3A), but the mixture 30 may be attached to both ends of the upper surface 21 in a direction of the short side 202 along a direction of the long side 201 in a thickness larger than that of other positions of the upper surface 21 to provide a thick attached-material region 31 (FIG. 3B). According to this, it is possible to provide a large amount of $R^H$ to the both ends 25 of the base material 20 in the direction of the short side 202. The both ends 25 have the smallest thickness in the base material 20, and magnetization faces a thickness direction. Therefore, a demagnetizing field that is generated due to the magnetization is the largest in the base material 20, and thus a decrease in the coercive force tends to occur. In addition, when being mounted to a motor and the like, heat generation due to the demagnetizing field is large in the both ends 25, and thus a decrease in the coercive force tends to occur. In Examples, a large amount of $R^H$ is supplied to the both ends 25, and thus a decrease in the coercive force along with the heat generation may be prevented by local improvement of the coercive force at the both ends 25. In addition, FIG. 3B illustrates a configuration in which the mixture 30 is not attached to the lower surface 22, but the mixture 30 may also be attached to the lower surface 22.

Figure 4:
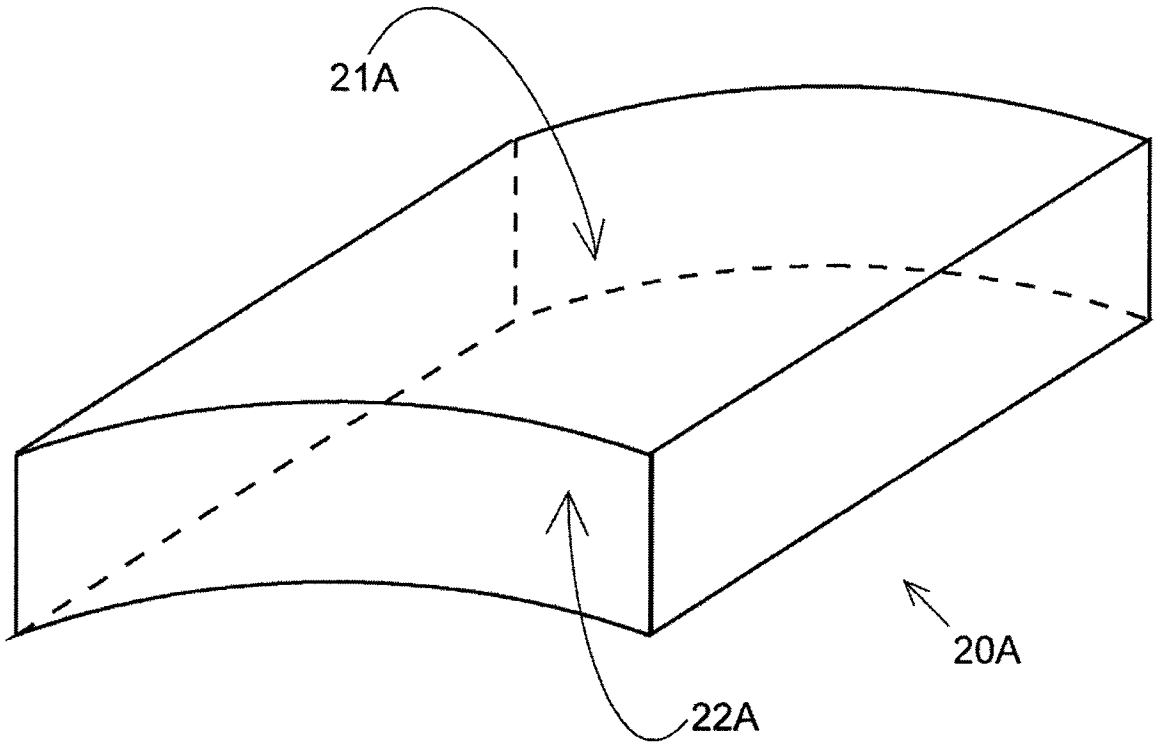
FIG. 4 is a perspective view illustrating another example of the shape of the base material.

In Examples, the base material 20, in which only one surface (upper surface 21) is set as a nonplanar surface, and the nonplanar surface has a convex shape, was used. However, the shape of the base material is not limited thereto. For example, as shown in FIG. 4, a base material 20A, in which an upper surface 21A has an upwardly convex arc shape and a lower surface 22A also has an upwardly convex arc shape in the same manner as the upper surface 21A, may be used. In the base material 20A, when the lower surface 22A is set as the attachment surface of the mixture 30 in combination with the upper surface 21A, the mixture 30 is attached to a concave surface, but according to Examples, it is possible to uniformly attach the mixture 30 to the concave surface in an arbitrary thickness similar to the convex surface.

While the mode for carrying out the present invention has been described in detail above, the present invention is not limited to these embodiments, and various changes and modifications can be made therein without departing from the purport of the present invention.

This application is based on Japanese patent application No. 2013-196922 filed Sep. 24, 2013, the entire contents thereof being hereby incorporated by reference.

DESCRIPTION OF REFERENCE NUMERALS AND SIGNS

10: Mixture supply apparatus
11: Base material holding unit
12: Nozzle head
121: Nozzle
13: Base material transporting unit
14: Mixture supply unit
141: Mixture tank
142: Supply tube
20, 20A: Base material
201: Long side of lower surface 22
202: Short side of lower surface 22
21, 21A: Upper surface (attachment surface)
22: Lower surface
22A: Lower surface (attachment surface)
231: First side surface
232: Second side surface
233: Third side surface
234: Fourth side surface
30: Mixture

What is claimed is:

1. A method for producing an RFeB-based magnet, the method comprising:

disposing a nozzle so as to be opposed to an attachment surface of a base material, which is held by a base material holding unit so that the attachment surface faces upward, which has an upwardly convex arc shape in a cross-section, and which is a sintered magnet or hot-plastic worked magnet composed of an RFeB-based magnet containing a light rare earth element $R^L$ that is at least one element selected from the group consisting of Nd and Pr, Fe, and B;

transporting the base material holding unit using a base material transporting unit so that the base material holding unit is immediately below a nozzle head of the nozzle;

extruding a mixture, which is obtained by mixing an organic solvent, which is a silicone grease or flowable paraffin, and an $R^H$-containing powder containing a heavy rare earth element $R^H$ that is at least one element selected from the group consisting of Dy, Tb and Ho, from the nozzle, by moving a valve element or a piston or by pressure when receiving an electrical signal, while moving the nozzle with respect to the attachment surface so as to attach the mixture to the attachment surface;

transporting the base material holding unit away from immediately below the nozzle head of the nozzle using the base material transporting unit;

transporting, using the base material transporting unit, a subsequent base material holding unit, which holds base material that has an attachment surface facing upward, so that the subsequent base material holding unit is immediately below the nozzle head of the nozzle and so that the mixture is attached to an attachment surface of a plurality of base materials; and heating the base material together with the mixture.

2. The method for producing an RFeB-based magnet according to claim 1, wherein a ratio of a maximum particle size of the $R^H$-containing powder to a diameter of the nozzle is 0.15 or less.

3. The method for producing an RFeB-based magnet according to claim 1, wherein a viscosity of the mixture is 1 to 30 Pa·s.

4. The method for producing an RFeB-based magnet according to claim 1, wherein different amounts of the mixture are attached to the attachment surface based on each position on the attachment surface.

5. A method for producing an RFeB-based magnet, the method comprising:

disposing a nozzle so as to be opposed to an attachment surface of a base material that has an upwardly convex arc shape in a cross-section and is a sintered magnet or hot-plastic worked magnet composed of an RFeB-based magnet containing a light rare earth element $R^L$ that is at least one element selected from the group consisting of Nd and Pr, Fe, and B;

extruding a mixture, which is obtained by mixing an organic solvent and an $R^H$-containing powder containing a heavy rare earth element $R^H$ that is at least one element selected from the group consisting of Dy, Tb and Ho, from the nozzle while moving the nozzle with respect to the attachment surface so as to attach the mixture to the attachment surface; and heating the base material together with the mixture.

* * * * *